United States Patent [19]

Nelson et al.

[11] Patent Number: 4,952,898

[45] Date of Patent: Aug. 28, 1990

[54] TRANSFORMER SECONDARY BUSS ADAPTER APPARATUS

[76] Inventors: Charles E. Nelson, 2045 Taunton Rd.; Warren D. McClellan, 1538 Tiber Ave., both of Jacksonville, Fla. 32207

[21] Appl. No.: 434,860

[22] Filed: Nov. 7, 1989

[51] Int. Cl.[5] ..... H01F 15/02; H01F 27/04

[52] U.S. Cl. ..... 336/65; 336/107; 439/307; 439/921

[58] Field of Search ..... 439/307, 801, 921, 793, 439/794, 795, 796, 797, 798; 336/65, 90, 94, 105, 107

[56] References Cited

U.S. PATENT DOCUMENTS

| | | | |
|---|---|---|---|
| 3,003,085 | 10/1961 | Rund | 361/367 |
| 3,389,369 | 6/1968 | Curtis | 174/36 |
| 3,602,869 | 8/1971 | Metz et al. | 123/478 |
| 3,966,296 | 6/1976 | Ericson | 439/801 |
| 4,211,460 | 7/1980 | Seelbach et al. | 439/338 |

OTHER PUBLICATIONS 4 color photographs (attached to 2 sheets of white bond paper) of a standard residential transformer.

*Primary Examiner*—Thomas J. Kozma
*Attorney, Agent, or Firm*—Henderson & Sturm

[57] ABSTRACT

The present invention relates to a transformer secondary buss adapter having a rigid member constructed of an electrically conducted material wherein the top end of the member is substantially flat on two sides and has a hole therethrough. A threaded stud is attached to the other end thereof and has a threaded nut thereon for connecting a buss bar thereto. The transformer secondary buss adapter is used to obviate the need for splicing when an old style shorter transformer is replaced by a taller, newer model.

2 Claims, 2 Drawing Sheets

TRANSFORMER SECONDARY BUSS ADAPTER APPARATUS

TECHNICAL FIELD

The present invention relates generally to the replacement of transformers and more particularly to a transformer secondary buss adapter for use in situations where a shorter transformer is replaced by a taller one in order to eliminate the need to splice cables.

BACKGROUND ART

Electrical outages seemingly occur when they are least expected, for example when lightning strikes a power pole, when tree limbs fall tearing down electrical lines or when a car skids into a pad mounted transformer on the ground or the like. Whatever the reason for power failure, restoration of power is of great concern to a power company and to its customers.

Because underground electrical installations have less outages than do overhead power lines, power companies are slowly phasing out aerial wire and pole mounted transformers. They are being replaced by pad mounted transformers. These transformers, made by various manufacturers such as General Electric, Westinghouse, Allis Chalmers, etc., in the past have had a standard height and width. Single phase transformers are ordered a standard height regardless of KVA rating. This standardization facilitates interchangeability between KVA ratings. The newer models however, are now approximately ten inches higher than the old ones. This added height results in a situation where the resident's house service cable is too short to bolt back up to the factory secondary (120/240 volt) buss. In order to lengthen the cable so that it will reach, splicing is necessary. This splicing procedure is costly and time consuming. Accordingly, there is a need for structures and methods to overcome this problem.

DISCLOSURE OF THE INVENTION

The present invention relates to a transformer secondary buss adapter having a rigid member constructed of an electrically conductive material wherein the top end of the member is substantially flat on two sides and has a hole therethrough. A threaded stud is attached to the other end thereof and has a threaded nut thereon for connecting a buss bar thereto. The transformer secondary buss adapter is used to obviate the need for splicing when an old style shorter transformer is replaced by a taller, newer model.

An object of the present invention is to provide a transformer secondary buss adapter.

A further object of the present invention is to provide a method and apparatus for eliminating the need to splice cables in order to lengthen them for connection to a transformer when a shorter transformer is replaced by a taller one.

Other objects, advantages, and novel features of the present invention will become apparent from the following detailed description of the invention when considered in conjunction with the accompanying drawings.

BEST MODE FOR CARRYING OUT THE INVENTION

Figure 5:
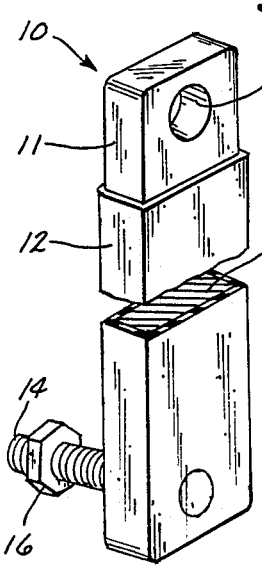
FIG. 5 is a perspective view of a transformer secondary buss adapter constructed in accordance with the present invention.
Figure 6:
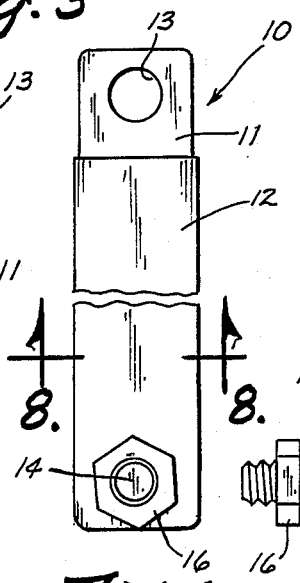
FIG. 6 is a front view of the transformer secondary buss adapter.
Figure 7:
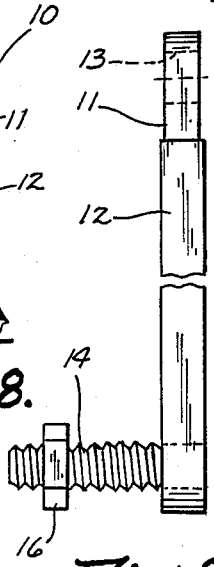
FIG. 7 is a side elevational view of the transformer secondary buss adapter.
Figure 8:
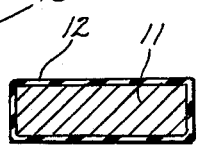
FIG. 8 is a cross sectional view taken along line 8—8 of FIG. 6.

Referring now to the drawings wherein like reference numerals designate identical or corresponding parts throughout the several views, FIG. 5 shows a transformer secondary buss adapter (10) constructed in accordance with the present invention. The adapter (10) includes a thick metal flat bar member (11) made of a material which is a good conductor of electricity and which will carry the desired amount of electricity needed. It is insulated throughout most of its length by a 600-volt rating rubber (12) or some other good insulator. The member (11) has a hole (13) disposed therethrough and the lower portion thereof has a stud (14) and threaded nut (16) threadably engaging the stud (14). This transformer secondary buss adapter (10) can be made in various lengths. Although only one length is shown, normally the neutral connection is lower and so the adapter (10) can be made shorter than the ones made for the phase connections.

Figure 1:
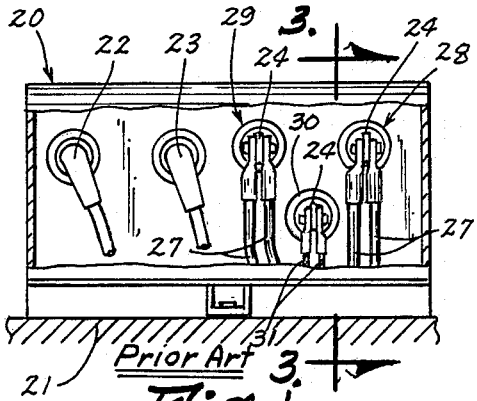
FIG. 1 is a front elevational view of a short transformer having larger inlet lines on the left and smaller outlet lines on the right.
Figure 3:
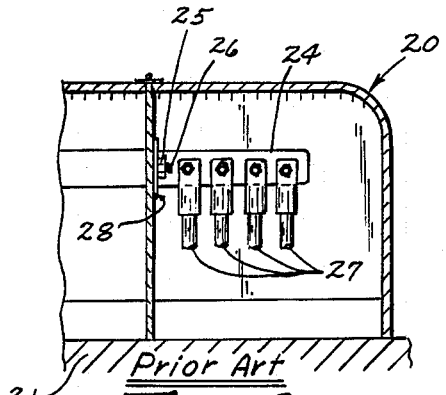
FIG. 3 is an enlarged partial cross sectional view taken along line 3—3 of FIG. 1 and showing a buss bar having eight outlet cables attached thereto.

Referring to FIG. 1, it is noted that a regular transformer (20) of the older and shorter type is attached to a pad (21) and has inlet cables (22) and (23) attached thereto. These cables (22) and (23) carry high voltage electricity to the primary coils (not shown) of the transformer (20). In FIG. 3, the secondary coils (not shown) are connected to a buss bar (24) by a nut (25) threaded onto a stud (26), which is connected to one phase of the secondary coils so that eight cables (27) can be attached to the buss bar (24) for servicing residences or businesses with electrical power.

Referring to FIG. 1, it will be noted that phase connections (28) and (29) each have a buss bar (24) attached thereto and cables (27) leading therefrom. A neutral connection (30) has a plurality of neutral cables (31) leading from a buss bar (24), which is identical to the buss bar (24) for phase connections (28) and (29).

Figure 2:
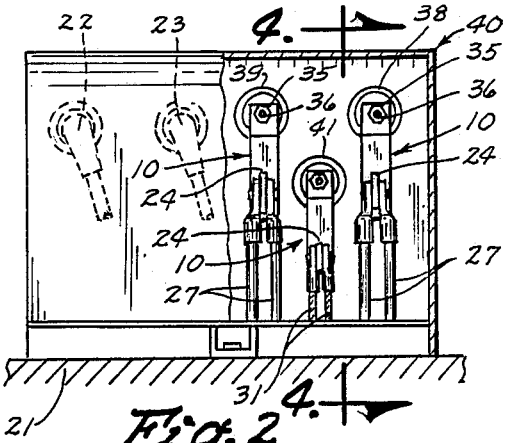
FIG. 2 is a front elevational view of a newer style taller transformer having transformer secondary buss adapters attached thereto.
Figure 4:
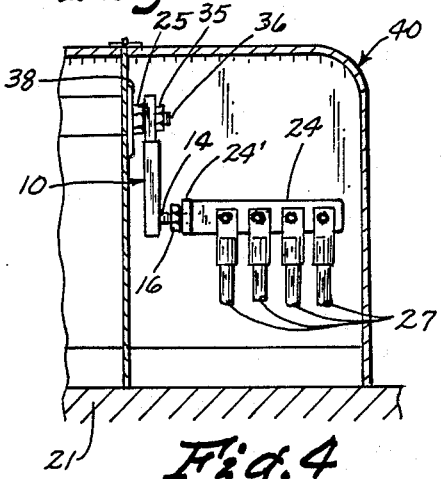
FIG. 4 is a cross sectional view taken along line 4—4 of FIG. 2 and showing a transformer secondary buss adapter attached to a buss bar on the lower end thereof and the top thereof is attached to a secondary coil of the transformer.

When this older type transformer (20) is replaced, it is almost always replaced by the newer standard model (40) shown in FIGS. 2 and 4 and this standard newer model (40) is about ten inches taller than the older standard model (20). Since these cables (27) and (31) are fixed in length and extend up through the pad (21) and through the ground therebelow, they will not reach the phase connections (38) and (39) on the newer model

(40) and the neutral cables (31) will not reach the neutral connection (41) on the transformer (40).

To eliminate the need for splicing of the cables (27) and (31), which is very time consuming and therefore costly to the power company, transformer secondary buss adapters (10) are used in the manner shown in FIGS. 2 and 4 wherein studs (36) which are connected to the secondary coil of a transformer (40), are placed through the openings (13) in the transformer secondary buss adapter (10) and nuts (35) are utilized to hold the top of the rigid member (11) in place and to form a good electrical connection thereat.

Figure 9:
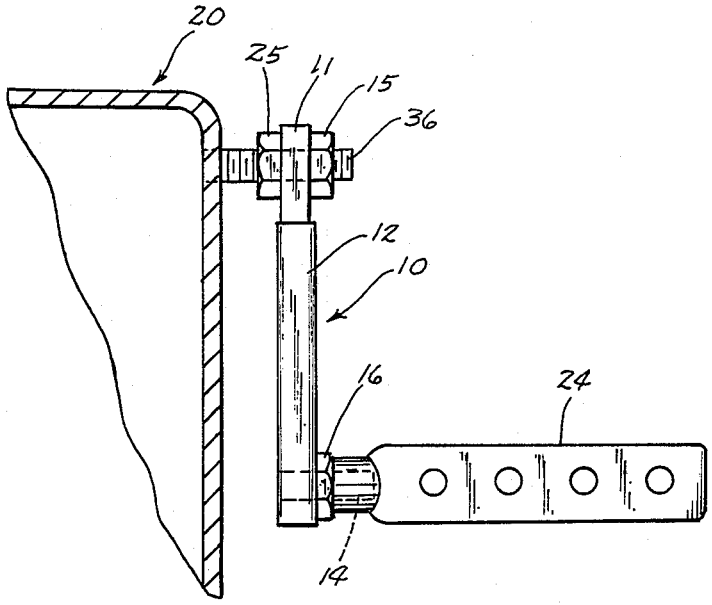
FIG. 9 is a view similar to FIG. 4.

The buss bar (24), which has been removed from the old transformer (20) in FIGS. 1 and 3 is then attached to the stud (14) on the secondary buss adapter (10) and a good electrical connection is made by tightening the nut (16) down against the apertured flange (24'). The outlet cables (27) can then be reattached to the buss bar (24) in the process, which makes the transition from utilization of the old transformer (20) to the new and taller transformer (40) as quick as possible. The secondary buss adapter (10) is of course connected to both of the phase connections (38) and (39) and to the neutral connection (41). This is accomplished by removing nut (25) (FIG. 3) from the existing transformer and then screwing nut (25) to the new transformer. Buss adapter (10) is then slid over stud (36). Finally, adapter (10) is locked in place by installing nut (35) and tightening it down. See FIG. 9. If desired, a shorter secondary buss adapter can be utilized on the neutral connection (41) since it does not normally need to be as long as the ones for the phase connections (38) and (39). For convenience, they are shown to be identical in FIG. 2.

Obviously, many modifications and variations of the present invention are possible in light of the above teachings. It is therefore to be understood that, within the scope of the appended claims, the invention may be practiced otherwise than as specifically described.

We claim:

1. Apparatus comprising:

a concrete pad;

an enclosed housing attached to said concrete pad;

door means for selectively opening and closing said housing;

an electrical transformer having a primary and a secondary coil disposed in and attached to said housing;

an electrical inlet line means for delivering high voltage electricity to the primary coil of said transformer;

a plurality of electrical outlet line means for delivering low voltage electricity from the transformer secondary coil to residential homes or the like;

a transformer secondary buss adapter means for connecting said plurality of electrical outlet line means to said secondary coil, said transformer secondary buss adapter means including:

a rigid member constructed of an electrically conductive material, a top end of said member being substantially flat on two sides thereof and having a hole disposed therethrough;

a first threaded stud having one end operatively electrically connected to said secondary coil of the transformer, said threaded stud extending through the hole in said rigid member;

threaded nut means disposed on said threaded stud for holding said rigid member on said stud whereby a good electrical conductive connection is made between said rigid member and said threaded stud;

a second threaded stud rigidly attached to the bottom of said rigid member;

insulation means completely surrounding said rigid member on a portion thereof between the hole thereof and the second threaded stud thereof for preventing electricity from being transmitted therethrough;

a buss bar for connecting a said plurality of electrical line means thereto; and means for attaching said buss bar to said second threaded stud whereby a low voltage electrical current will pass from said secondary coil, through said rigid member to said buss bar and from said buss bar out through said plurality of electrical outlet line means.

2. The apparatus of claim 1 wherein said buss bar comprises and electrically conductive elongated rigid member having a plurality of openings disposed therethrough, each of said openings being formed about an axis and each of the axes of said openings being generally parallel to each other;

wherein one end of said buss bar has a connection hole therein, said second threaded stud extending through said connection hole of the buss bar; and said means for attaching includes threads attached to said second stud for holding said buss bar in electrical contact with said second stud.

* * * * *